US012049764B1

(12) United States Patent
Lyle, II

(10) Patent No.: US 12,049,764 B1
(45) Date of Patent: Jul. 30, 2024

(54) WALL JACK

(71) Applicant: David R. Lyle, II, Orting, WA (US)

(72) Inventor: David R. Lyle, II, Orting, WA (US)

( * ) Notice: Subject to any disclaimer, the term of this patent is extended or adjusted under 35 U.S.C. 154(b) by 0 days.

(21) Appl. No.: 17/751,856

(22) Filed: May 24, 2022

(51) Int. Cl.
*E04G 17/00* (2006.01)
*E04G 17/16* (2006.01)

(52) U.S. Cl.
CPC ..... *E04G 17/002* (2013.01); *E04G 17/16* (2013.01)

(58) Field of Classification Search
CPC ..... E04G 17/002; E04G 17/14; E04G 17/16; E04G 2011/067; E04G 5/165
See application file for complete search history.

(56) References Cited

U.S. PATENT DOCUMENTS 2,577,979 A * 12/1951 Pierson ..... E04G 5/06 248/235
2,805,902 A * 9/1957 Von Drasek ..... E04G 17/04 248/235
3,674,234 A * 7/1972 Davin ..... E04G 17/002 182/87
3,698,680 A * 10/1972 Shoemaker ..... E04G 17/002 249/189
3,960,355 A * 6/1976 Prichard, Jr. ..... E04G 17/002 269/208
4,397,441 A * 8/1983 Manderla ..... E04G 17/002 249/19
5,388,663 A * 2/1995 Phillippe ..... E04G 17/002 248/246
6,237,890 B1 5/2001 Gates
6,250,024 B1 6/2001 Sculthorpe et al.
6,550,188 B2 4/2003 Bolinger et al.
6,955,242 B2 10/2005 Markovich
7,360,627 B2 * 4/2008 Scott ..... A47B 96/061 182/150
8,673,189 B2 3/2014 Schwoerer
9,045,912 B2 6/2015 Fearn
9,784,002 B2 10/2017 Cymbala
10,676,943 B2 6/2020 Laures et al.
2002/0003061 A1 * 1/2002 Philippe ..... E04G 3/28 182/224

(Continued)

FOREIGN PATENT DOCUMENTS

CA 2109501 A * 4/1995 ..... E04G 1/10
CH 551554 A * 7/1974 ..... E04G 11/00

(Continued)

*Primary Examiner* — Rodney Mintz
(74) *Attorney, Agent, or Firm* — Cramer Patent & Design PLLC; Aaron R. Cramer

(57) ABSTRACT

The wall jack may comprise a strongback coupler, a horizontal arm, a handrail holder, a support strut, and a support foot. The wall jack may be adapted to couple to a strongback of a concrete form. The strongback coupler may couple to the strongback by hanging on a bolt protruding from the strongback. The horizontal arm may extend away from the strongback coupler in a direction that is perpendicular to the concrete form. The support strut may brace the horizontal arm diagonally between a midpoint of the horizontal arm and the support foot pressing against the strongback at a location that is below the strongback coupler. The handrail holder may retain a handrail post in a vertical orientation. The wall jack may be used in groups of two or more to support scaffold planks or walk boards of a scaffold.

20 Claims, 7 Drawing Sheets

(56) References Cited

U.S. PATENT DOCUMENTS

| | | | | |
|---|---|---|---|---|
| 2002/0073634 | A1* | 6/2002 | Bolinger | E04G 21/26 52/127.2 |
| 2004/0007423 | A1* | 1/2004 | Scott | A47B 96/061 182/113 |
| 2004/0112675 | A1* | 6/2004 | Markovich | E04G 17/002 182/82 |
| 2004/0154864 | A1* | 8/2004 | Wagner | E04G 5/06 182/150 |
| 2006/0156675 | A1* | 7/2006 | Nelson | E04G 17/002 52/633 |
| 2013/0318888 | A1* | 12/2013 | Schwoerer | E04G 11/28 52/745.2 |
| 2014/0166849 | A1* | 6/2014 | Fearn | E04G 17/14 249/219.2 |
| 2016/0258170 | A1* | 9/2016 | Cymbala | E04G 5/067 |
| 2017/0335580 | A1* | 11/2017 | Laures | E04G 17/14 |

FOREIGN PATENT DOCUMENTS

| | | | | |
|---|---|---|---|---|
| DE | 2142150 | A1 * | 3/1972 | E04G 17/002 |
| DE | 2203894 | A1 * | 8/1973 | E04G 17/002 |
| DE | 2402576 | A1 * | 8/1974 | E04G 17/002 |
| DE | 29505701 | U1 * | 8/1995 | E04G 17/002 |
| DE | 202016003968 | U1 * | 8/2016 | E04G 17/16 |
| EP | 1233122 | A2 * | 8/2002 | E04G 1/14 |
| EP | 2189593 | A1 * | 5/2010 | E04G 11/065 |
| EP | 3712354 | B1 * | 11/2021 | E04G 17/002 |
| FR | 2239128 | A * | 3/1975 | E04G 17/14 |
| FR | 2609488 | A1 * | 7/1988 | E04G 17/002 |
| FR | 2610348 | A1 * | 8/1988 | E04G 17/002 |
| FR | 2776004 | A1 * | 9/1999 | E04G 17/002 |
| FR | 2857398 | A1 * | 1/2005 | E04G 17/16 |
| FR | 2941254 | A1 * | 7/2010 | E04G 17/002 |
| FR | 2944041 | A1 * | 10/2010 | E04G 17/002 |
| FR | 3018536 | A1 * | 9/2015 | E04G 1/34 |
| GB | 2090901 | A * | 7/1982 | E04G 3/292 |
| KR | 2006060999 | A * | 6/2006 | E04G 13/04 |
| KR | 2006078341 | A * | 7/2006 | E04G 17/002 |
| KR | 100611532 | B1 * | 8/2006 | E04G 17/002 |
| KR | 20110018601 | A * | 2/2011 | E04G 17/002 |
| KR | 20130007502 | U * | 12/2013 | E04G 17/16 |

* cited by examiner

WALL JACK

RELATED APPLICATIONS

None.

FIELD OF THE INVENTION

The presently disclosed subject matter is directed to a jack and more specifically to a wall jack for scaffolding.

BACKGROUND OF THE INVENTION

There is a seemingly endless list of activities performed at construction or major remodeling projects that require the aid of scaffolding. Scaffolding allows work at elevated locations to progress at a much faster rate than if performed from a ladder. However, scaffolding is not without its drawbacks. First it is heavy and bulky to store and move from job site to job site. Secondly, it is time consuming to set up and adjust. Changes in elevations, as work progresses up or down a wall, require the readjustment of planking, or even the addition or subtraction of scaffolding sections. Finally, and perhaps most significantly, scaffolding requires a firm and level surface for placement. If the grade is outside and uneven, many users may opt to place blocks or other items beneath the scaffolding feet in order to level its foundation.

However, this is an unwise practice because the scaffolding can slip off the blocks, thus increasing the likelihood of injury rather than reducing it. Accordingly, there is a need for a means by which scaffolding can be easily and safely used, without the disadvantages as described above. The development of the wall jack is such a solution.

SUMMARY OF THE INVENTION

The principles of the present invention provide for wall jack that has a strongback coupler having a U-bracket and a wedge, a horizontal arm supporting a plurality of scaffold planks or the walk boards that are placed on top of the horizontal arm, a handrail holder having 4 side walls forming an open ended rectangular box to encompass a handrail post which is adapted to retain the handrail post in a vertical orientation at the end of the horizontal arm that is opposite the concrete form; a support strut adapted to brace the horizontal arm diagonally between a midpoint of the horizontal arm; and a support foot adapted to press against the strongback at the location that is below the strongback coupler. The strongback coupler is adapted to couple to a strongback of a concrete form by hanging on a bolt protruding from the strongback. The horizontal arm is a horizontally-oriented armature that couples to the U-bracket at one end and coupled to the handrail holder at an opposite end. The horizontal arm is adapted to extend horizontally away from the strongback coupler in a direction that is perpendicular to the concrete form. The support strut is coupled between the midpoint of the horizontal arm and the support foot pressing against the strongback at a location that is below the strongback coupler. The U-bracket couples to the strongback by hanging on the bolt protruding from the strongback.

The wall jack may be operable to tighten a coupling between the U-bracket and the bolt. The U-bracket may include a center plate, a left side plate, and a right side plate. The center plate may press against a first face of the strongback. The left side plate and the right side plate may be coupled to the center plate and may be oriented perpendicular to the center plate. The left side plate and the right side plate may press against a pair of sides of the strongback. The left side plate may include a plurality of left side mounting apertures and the right side plate may include a plurality of right side mounting apertures. A plurality of nails may be driven through one or all of the left side mounting apertures and the right side mounting apertures may be adapted to strengthen the coupling of the U-bracket onto the strongback. The center plate may include a hanger slot that is a vertically-oriented slot located at a center of the center plate. A width of the hanger slot may be wider than a shaft of the bolt but narrower than a diameter of a head of the bolt. The hanger slot may connect to the hanger aperture such that the U-bracket is hung on the bolt by pushing the head of the bolt though the hanger aperture and lowering the U-bracket such that the shaft of the bolt slide up into the hanger slot. The wedge may include a wedge plate, an inclined surface, and a wedge slot that forces the U-bracket against the strongback as the strongback coupler is lowered onto the bolt.

The wedge plate may be coupled to a first face of the center plate and may be a vertically-oriented slot located at the center of the wedge plate. The bottom of the wedge slot may include a wedge aperture. The width of the wedge slot may be equal to a width of the hanger slot and a diameter of the wedge aperture is equal to a diameter of the hanger aperture. The wedge slot and the wedge aperture may align with the hanger slot and the hanger aperture such that the bolt passes through both the center plate and the wedge plate simultaneously. The inclined surface may be located at the center of the wedge plate that is a vertically-oriented thickening of the wedge plate with the narrowest portion of the inclined surface is located at a bottom and a thickest portion of the inclined surface. A bottom of the inclined surface may end at a top of the wedge aperture and the wedge slot extends through the inclined surface such that the inclined surface does not prevent the bolt from sliding in the wedge slot. The pair of opposing sides of the 4 side walls may include a plurality of handrail apertures for nailing the handrail post into place from the sides. A top end of the support strut may be cut at an angle such that the top end of the support strut lies in a horizontal plane and a bottom end of the support strut may be cut at an angle such that the bottom end of the support strut lies in a vertical plane.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
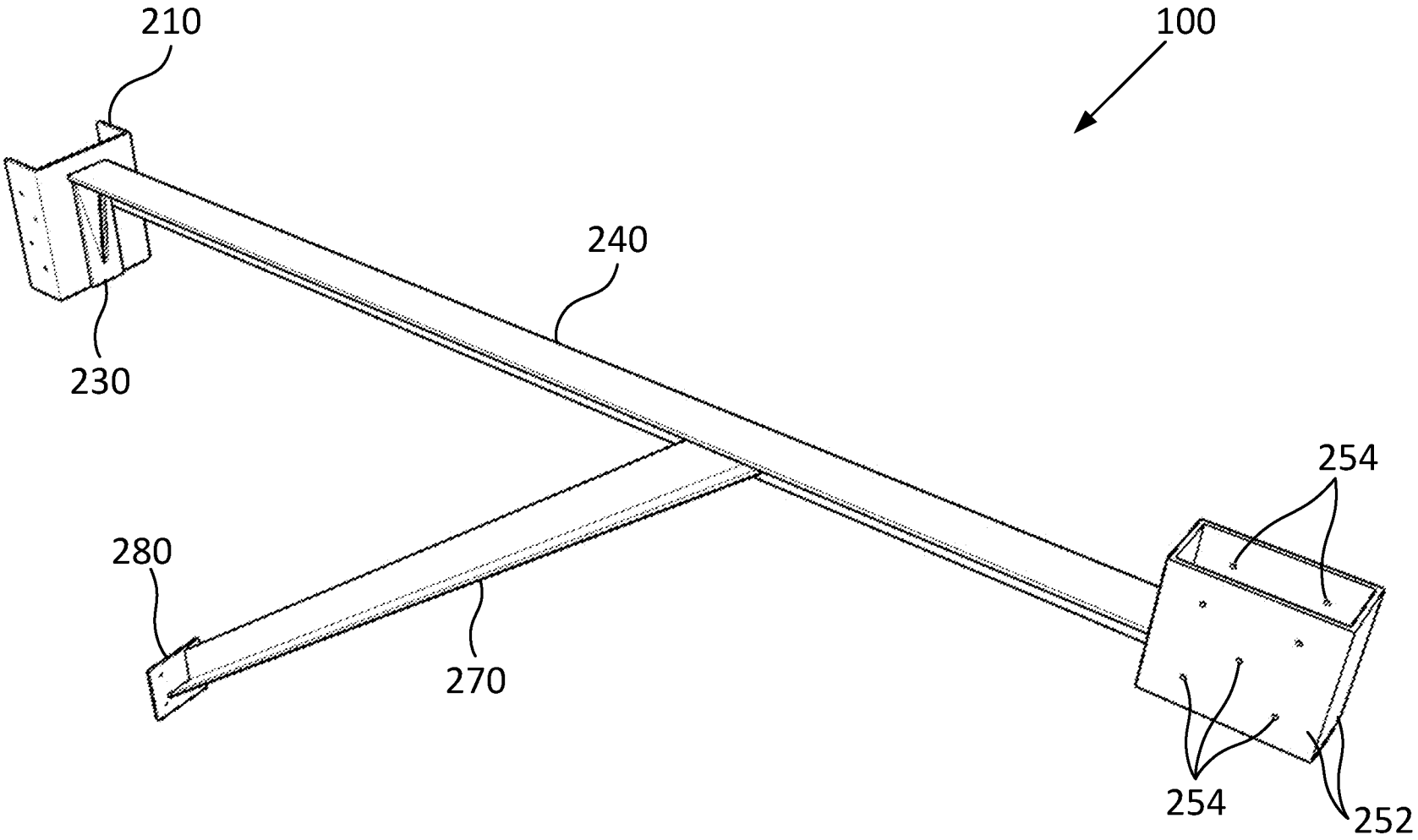
FIG. 1 is an isometric view of a wall jack, according to an embodiment of the present invention.
Figure 2:
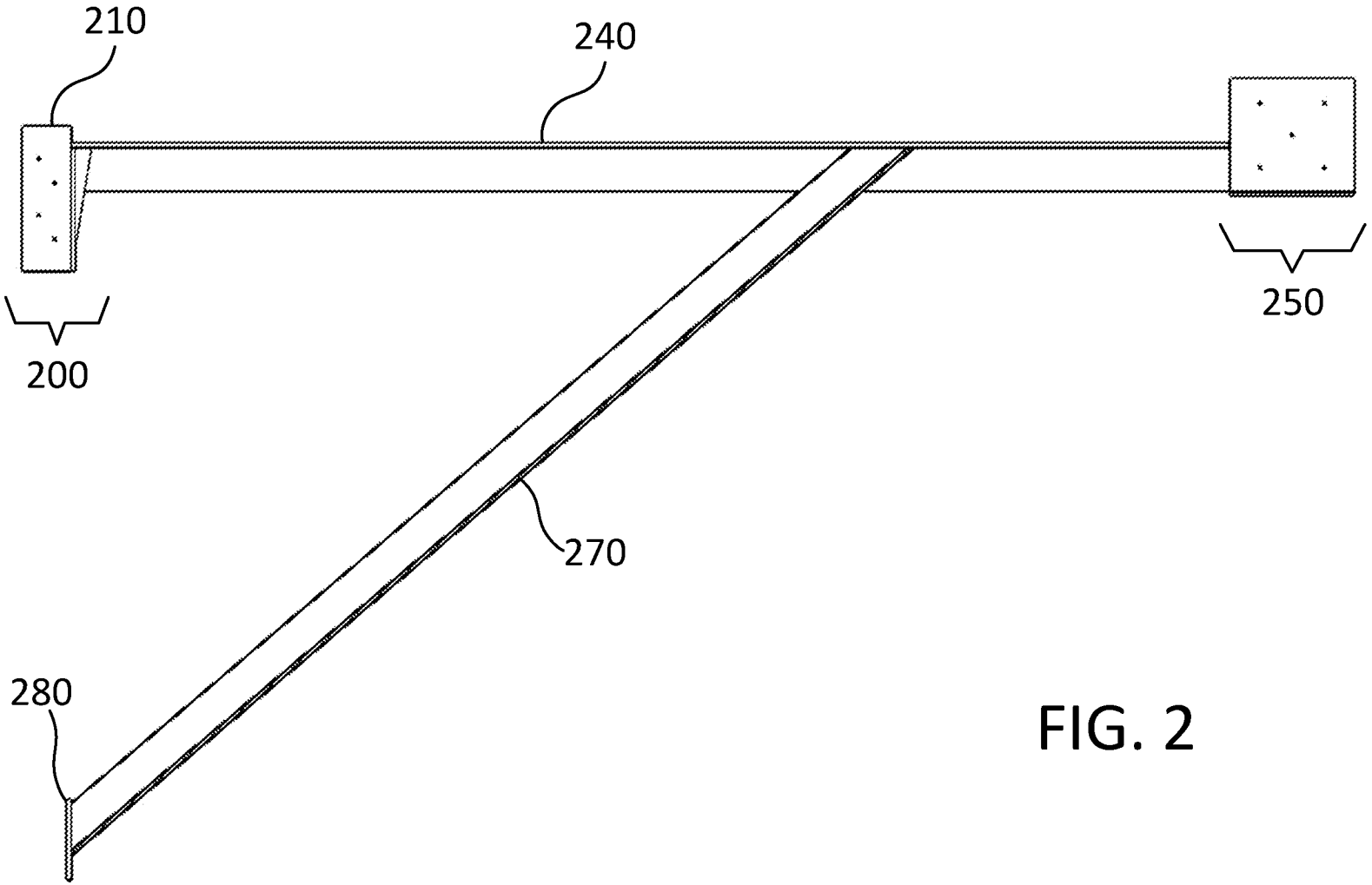
FIG. 2 is a side view of a wall jack, according to an embodiment of the present invention.
Figure 3:
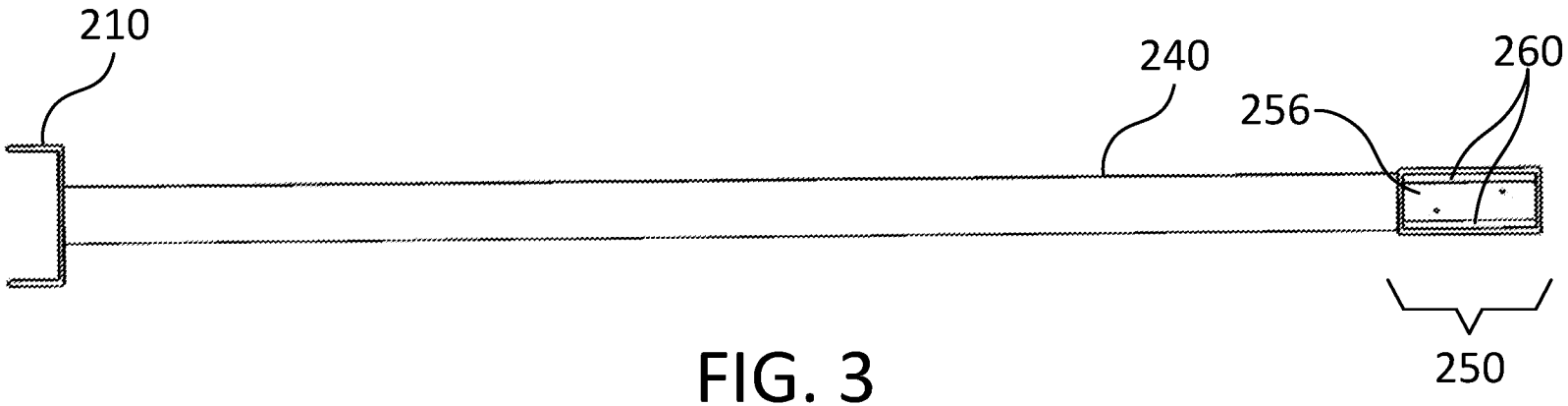
FIG. 3 is a top view of a wall jack, according to an embodiment of the present invention.
Figure 4:
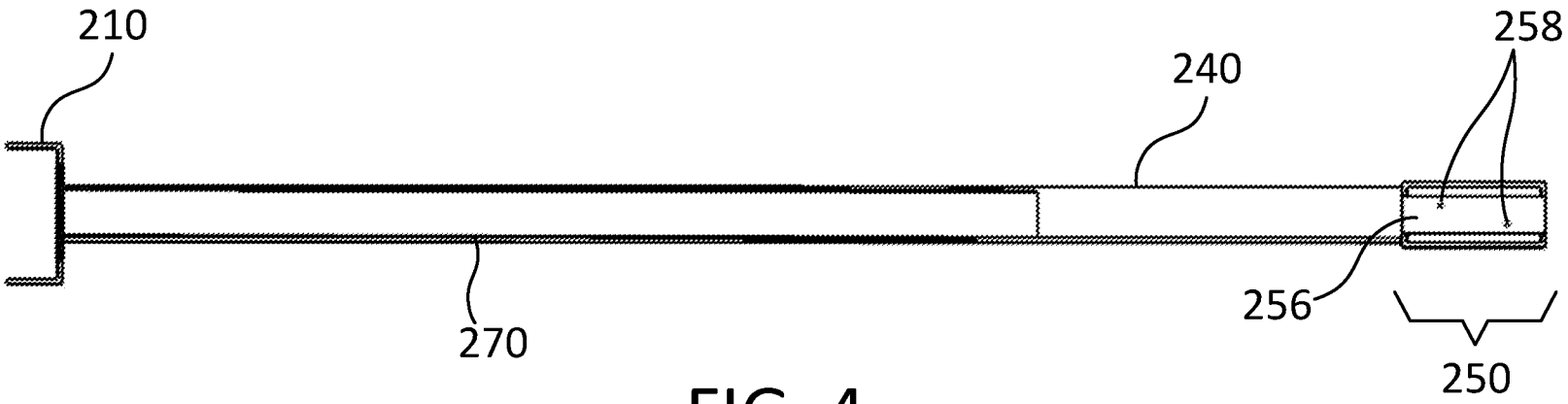
FIG. 4 is a bottom view of a wall jack, according to an embodiment of the present invention.
Figure 5:
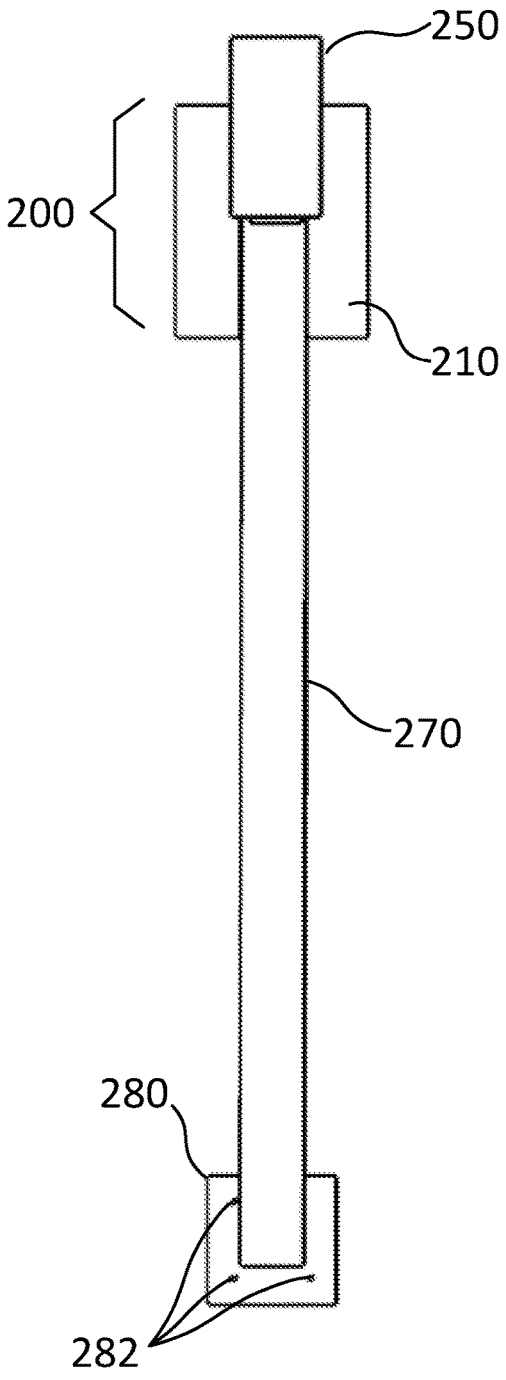
FIG. 5 is a front view of a wall jack, according to an embodiment of the present invention.
Figure 6:
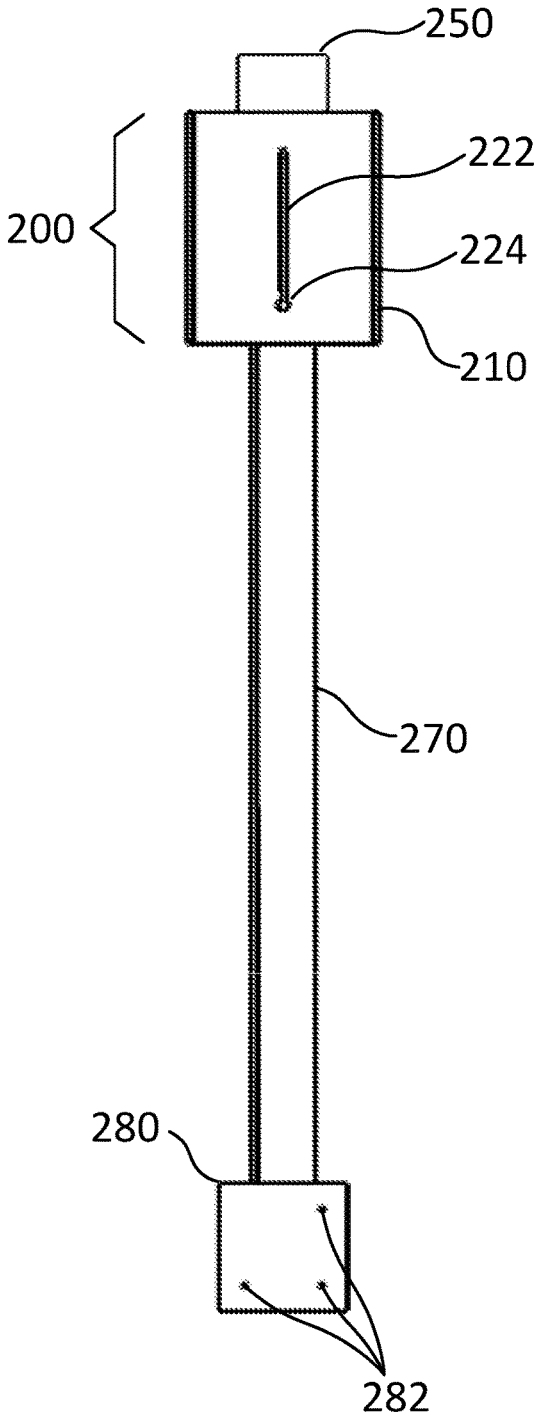
FIG. 6 is a rear view of a wall jack, according to an embodiment of the present invention.
Figure 7:
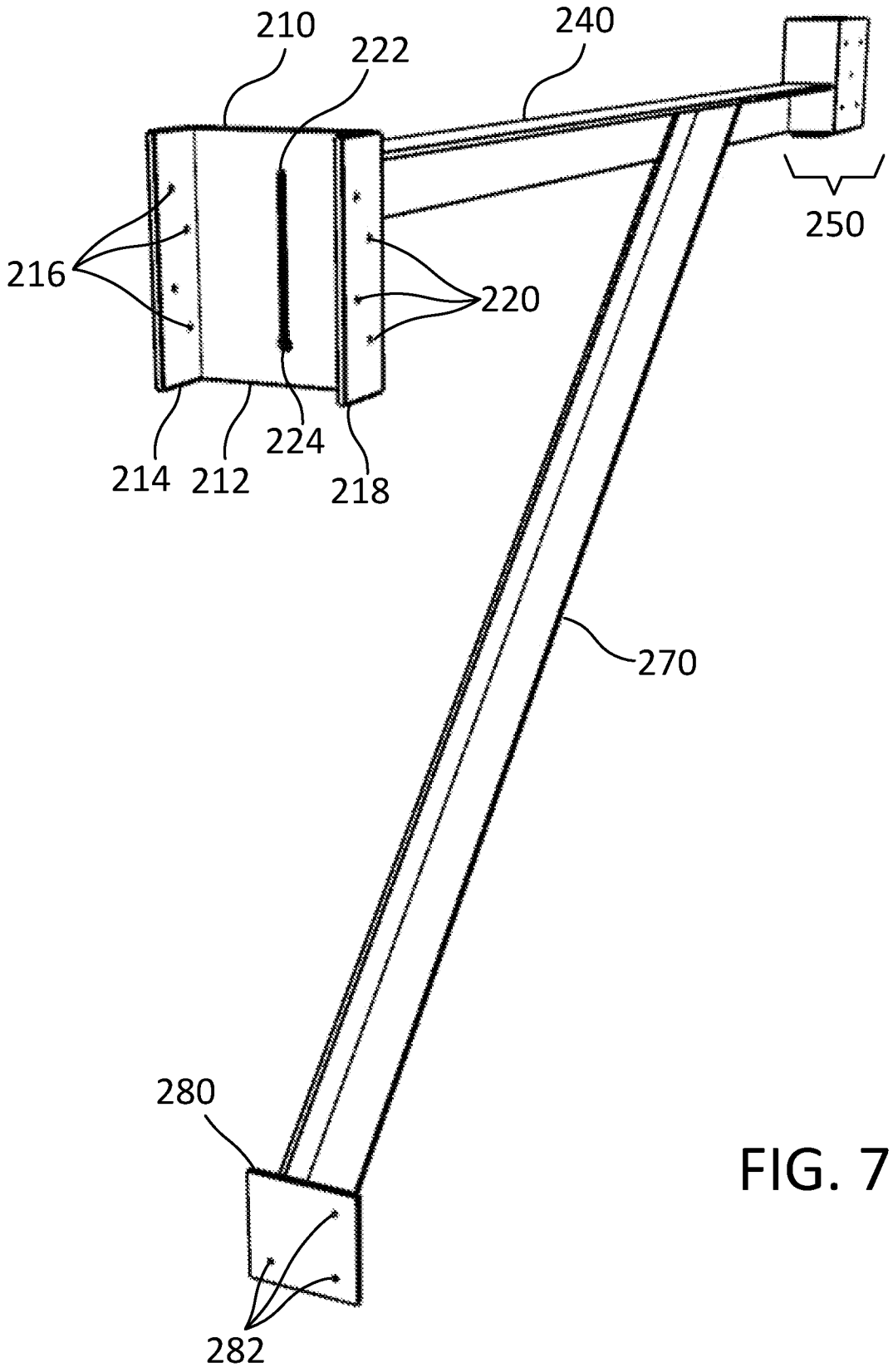
FIG. 7 is a reverse isometric view of a wall jack, according to an embodiment of the present invention.

100 wall jack
200 strongback coupler
210 U-bracket
212 center plate
214 left side plate
216 left side mounting aperture
218 right side plate
220 right side mounting aperture
222 hanger slot
224 hanger aperture
230 wedge
232 wedge plate
234 inclined surface
236 wedge slot
238 wedge aperture
240 horizontal arm
250 handrail holder
252 side wall
254 handrail aperture
256 bottom plate
258 bottom aperture
260 drainage aperture
270 support strut
280 support foot
282 foot aperture
900 concrete form
902 panel
904 stud
906 waler
908 strongback
910 handrail post
912 top rail
914 mid rail
920 bolt
932 scaffold plank
940 nail

DESCRIPTION OF THE INVENTION

The present invention is directed to a wall jack (herein described as the "invention") 100. The invention 100 may comprise a strongback coupler 200, a horizontal arm 240, a handrail holder 250, a support strut 270, and a support foot 280. The invention 100 may be adapted to couple to a strongback 908 of a concrete form 900. The strongback coupler 200 may couple to the strongback 908 by hanging on a bolt 920 protruding from the strongback 908. As non-limiting examples, the bolt 920 may be a breakaway clip or an anchor. The horizontal arm 240 may extend horizontally away from the strongback coupler 200 in a direction that is perpendicular to the concrete form 900. The support strut 270 may brace the horizontal arm 240 diagonally between a midpoint of the horizontal arm 240 and the support foot 280 pressing against the strongback 908 at a location that is below the strongback coupler 200. The handrail holder 250 may be adapted to retain a handrail post 910 in a vertical orientation at the end of the horizontal arm 240 that is opposite the concrete form 900. The invention 100 may be used in groups of two or more to support scaffold planks 932 or walk boards of a scaffold.

The strongback coupler 200 may comprise a U-bracket 210 and a wedge 230. The U-bracket 210 may couple to the strongback 908 by hanging on the bolt 920 protruding from the strongback 908 and the wedge 230 may be operable to tighten the coupling between the U-bracket 210 and the bolt 920.

The U-bracket 210 may comprise a center plate 212, a left side plate 214, and a right side plate 218. The center plate 212 may press against the distal face of the strongback 908. The left side plate 214 and the right side plate 218 may be coupled to the center plate 212 and may be oriented perpendicular to the center plate 212. The left side plate 214 and the right side plate 218 may press against the sides of the strongback 908.

The center plate 212 may comprise a hanger slot 222. The hanger slot 222 may be a vertically-oriented slot located at the center of the center plate 212. The width of the hanger slot 222 may be wider than the shaft of the bolt 920 but narrower than the diameter of the head of the bolt 920. The bottom of the hanger slot 222 may comprise a hanger aperture 224. The diameter of the hanger aperture 224 may be larger than the diameter of the head of the bolt 920. The hanger slot 222 may connect to the hanger aperture 224 such that the U-bracket 210 may be hung on the bolt 920 by pushing the head of the bolt 920 though the hanger aperture 224 and lowering the U-bracket 210 such that the shaft of the bolt 920 slide up into the hanger slot 222.

The left side plate 214 may comprise a plurality of left side mounting apertures 216 and the right side plate 218 may comprise a plurality of right side mounting apertures 220. Nails 940 may be driven through one (1) or all of the plurality of left side mounting apertures 216 and the plurality of right side mounting apertures 220 to strengthen the coupling of the U-bracket 210 onto the strongback 908.

The wedge 230 may comprise a wedge plate 232, an inclined surface 234, and a wedge slot 236. The wedge 230 may force the U-bracket 210 against the strongback 908 as the strongback coupler 200 is lowered onto the bolt 920. The wedge plate 232 may be coupled to the distal face of the center plate 212.

The wedge slot 236 may be a vertically-oriented slot located at the center of the wedge plate 232. The bottom of the wedge slot 236 may comprise a wedge aperture 238. The width of the wedge slot 236 may be substantially the same as the width of the hanger slot 222. The diameter of the wedge aperture 238 may be substantially the same at the diameter of the hanger aperture 224. The wedge slot 236 and the wedge aperture 238 may align with the hanger slot 222 and the hanger aperture 224 such that the bolt 920 may pass through both the center plate 212 and the wedge plate 232 at the same time.

The inclined surface 234 may be located at the center of the wedge plate 232. The inclined surface 234 may be a vertically-oriented thickening of the wedge plate 232 with the narrowest portion of the inclined surface 234 located at the bottom and the thickest portion of the inclined surface 234 located at the top. The bottom of the inclined surface 234 may end at the top of the wedge aperture 238. The wedge slot 236 may extend through the inclined surface 234 such that the inclined surface 234 does not prevent the bolt 920 from sliding in the wedge slot 236.

When the strongback coupler 200 is placed onto the bolt 920 there may be space between the head of the bolt 920 and the wedge plate 232 or between the strongback 908 and the center plate 212. As the strongback coupler 200 is lowered, the inclined surface 234 may press against the back side of the head of the bolt 920 and may push the strongback coupler 200 towards the strongback 908. When the center plate 212 is pressed against the strongback 908 and the inclined surface 234 is pressed against the head of the bolt 920, the strongback coupler 200 may stop descending.

The horizontal arm 240 may support the scaffold planks 932 or the walk boards that are placed on top of the horizontal arm 240. The horizontal arm 240 may be a horizontally-oriented armature that couples to the U-bracket 210 at one end and coupled to the handrail holder 250 at the opposite end.

The handrail holder 250 may be operable to hold the handrail post 910 in a vertical orientation. The handrail holder 250 may comprise four (4) side walls 252 forming an open ended rectangular box and dimensioned to encompass the handrail post 910 which may typically be a piece of two-by-four (2×4) lumber. Two (2) opposing sides of the four (4) side walls 252 may comprise a plurality of handrail apertures 254 for nailing the handrail post 910 into place from the sides.

The handrail holder 250 may further comprise a bottom plate 256 coupled to the bottom of the four (4) side walls 252 to prevent the handrail post 910 from sliding through the handrail holder 250. The bottom plate 256 may comprise one (1) or more bottom apertures 258 for nailing the handrail post 910 into place from the bottom. One (1) or more drainage apertures 260 between the bottom plate 256 and the four (4) side walls 252 may enable water to drain out of the handrail holder 250.

The support strut 270 may be adapted to provide additional support for the horizontal arm 240. The support strut 270 may be coupled between a midpoint of the horizontal arm 240 and the support foot 280 pressing against the strongback 908 at a location that is below the strongback coupler 200. The top end of the support strut 270 may be cut at an angle such that the top end of the support strut 270 lies in a horizontal plane. The bottom end of the support strut 270 may be cut at an angle such that the bottom end of the support strut 270 lies in a vertical plane.

In a preferred embodiment, the horizontal arm 240 and the support strut 270 may be made from steel angle iron, although not necessarily the same size angle iron.

The support foot 280 may be a flat plate that presses against the distal face of the strongback 908 at a location that is below the strongback coupler 200. The support foot 280 may be coupled to the bottom end of the support strut 270. The support foot 280 may comprise one (1) or more foot apertures 282 such that the support foot 280 may be nailed to the strongback 908 for stability.

In use, two (2) or more of the wall jacks 100 may be installed on strong backs 908 by passing bolts 920 in the strong backs 908 through hanger apertures 224 in strongback couplers 200 and by lowering the strongback couplers 200 such that the bolts 920 slide up into hanger slots 222. As the strongback couplers 200 drop, wedges 230 may push the strongback couplers 200 against the strong backs 908 and support feet 280 may also come into contact with the strong backs 908. Nails 940 may be driven into a plurality of left side mounting apertures 216 and a plurality of right side mounting apertures 220 of the strongback couplers 200 and into one (1) or more foot apertures 282 of the support feet 280 to secure the inventions 100 in place. If the scaffold is above a certain height, handrail posts 910 that are typically 42 inches in height may be lowered into handrail holders 250 and secured using nails through a plurality of handrail apertures 254 and one (1) or more bottom apertures 258. A top rail 912 and a mid-rail 914 may be coupled to the handrail posts 910 to complete the handrail. Finally, scaffold planks 932 or walk boards may be placed on top of horizontal arms 240 to create a walkway for the scaffold.

Figure 8:
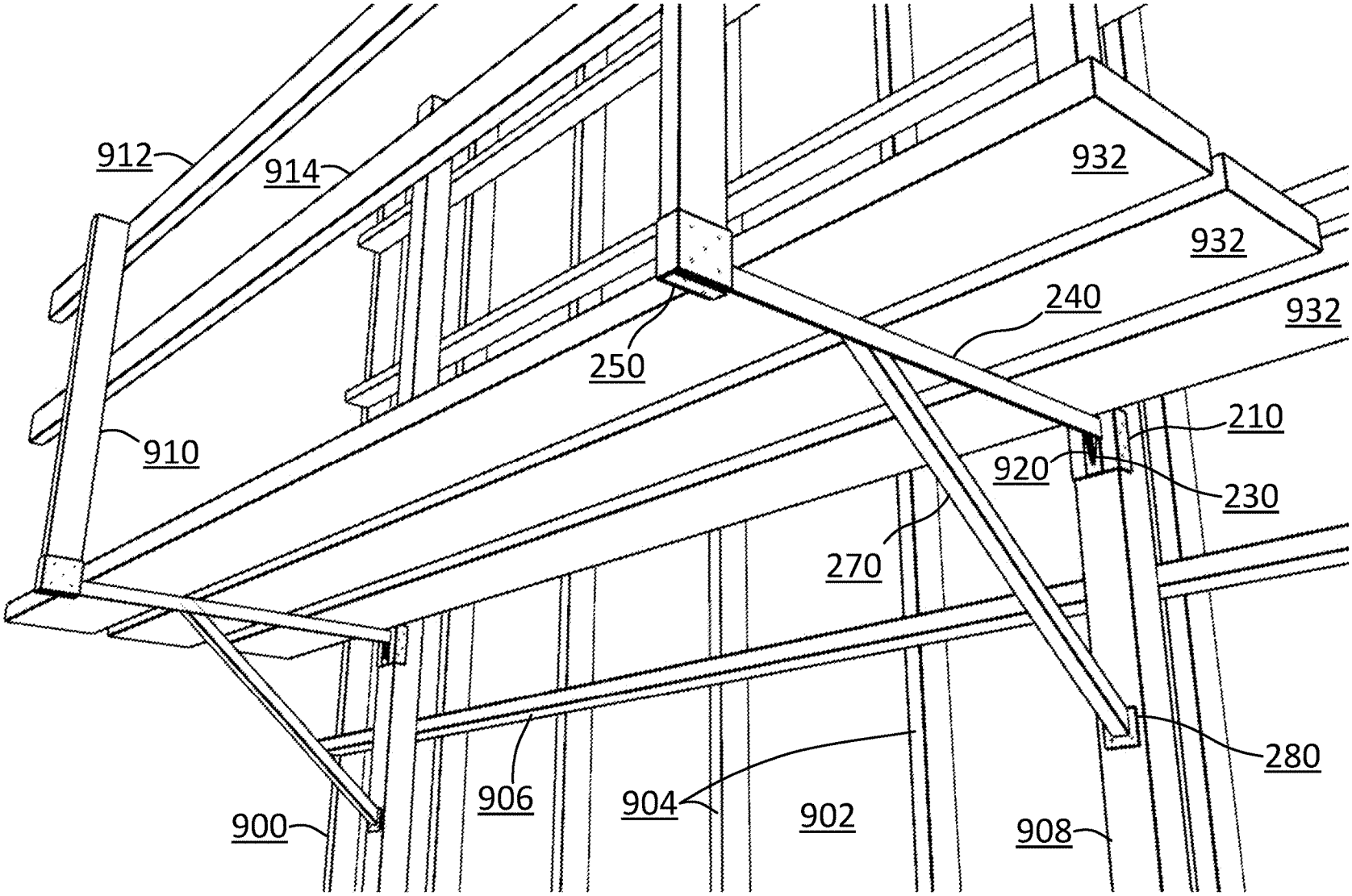
FIG. 8 is an in-use view of a wall jack, according to an embodiment of the present invention, illustrating two wall jacks forming part of a scaffold attached to a concrete form.
Figure 9:
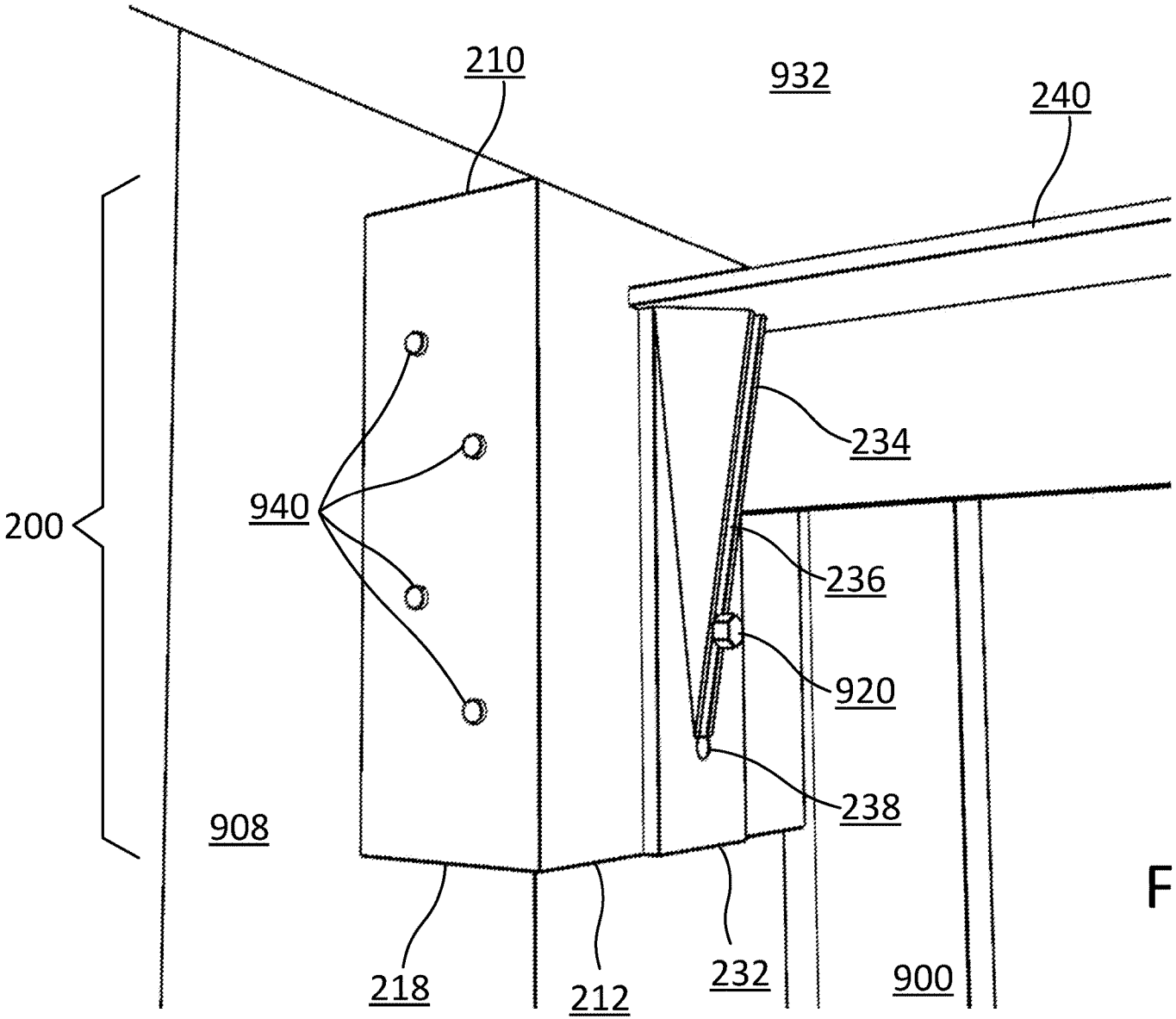
FIG. 9 is a detail view of a wall jack, according to an embodiment of the present invention, illustrating attachment of the strongback coupler to the strongback.

Note that a concrete form 900 may be constructed using many different techniques. The non-limiting example of a concrete form 900 shown in FIG. 8 uses panels 902 that are operable to constrain the placement of concrete. The panels 902 may be held in place by studs 904 which may be vertical members that are attached to the panels 902. The studs 904 may provide support and resistance to panel bending. Walers 906 may be attached to the studs 904. The walers 906 may be horizontal members that reinforce the studs 904 to resist bending and axial movement. The strong backs 908 may be vertical members attached to the walers 906 to align the walers 906. Diagonal braces from the strong backs 908 to the ground may typically be included but are not shown in FIG. 8 in order to simply the diagram.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A wall jack, comprising:

a strongback coupler having a U-bracket and a wedge, the strongback coupler is configured to couple to a strongback of a concrete form by hanging on a bolt protruding from the strongback;

a horizontal arm supporting a plurality of scaffold planks that are placed on top of the horizontal arm, the horizontal arm is a horizontally-oriented armature that couples to the U-bracket at one end and is coupled to a handrail holder at an opposite end, and the horizontal arm is configured to extend horizontally away from the strongback coupler in a direction that is perpendicular to the concrete form;

a handrail holder having four side walls forming an open ended rectangular box to encompass a handrail post which is configured to retain the handrail post in a vertical orientation at a respective said end of the horizontal arm that is opposite the concrete form;

a support strut configured to brace the horizontal arm diagonally between a midpoint of the horizontal arm and a support foot; and said support foot configured to press against the strongback at a location that is below the strongback coupler, the support strut is coupled between the midpoint of the horizontal arm and the support foot with the support foot pressing against the strongback at the location that is below the strongback coupler;

wherein the U-bracket couples to the strongback by hanging on the bolt protruding from the strongback.

2. The wall jack according to claim 1, wherein the wedge is operable to tighten a coupling between the U-bracket and the bolt.

3. The wall jack according to claim 1, wherein a pair of opposing sides of the four side walls include a plurality of handrail apertures for nailing the handrail post into place from the pair of opposing sides.

4. The wall jack according to claim 1, wherein a top end of the support strut is cut at an angle such that the top end of the support strut lies in a horizontal plane and a bottom end of the support strut is cut at an angle such that the bottom end of the support strut lies in a vertical plane.

5. The wall jack according to claim 1, wherein the U-bracket includes a center plate, a left side plate, and a right side plate.

6. The wall jack according to claim 5, wherein the center plate presses against a first face of the strongback.

7. The wall jack according to claim 5, wherein the left side plate and the right side plate is coupled to the center plate and is oriented perpendicular to the center plate.

8. The wall jack according to claim 5, wherein the left side plate and the right side plate press against a pair of sides of the strongback.

9. The wall jack according to claim 5, wherein the left side plate include a plurality of left side mounting apertures and the right side plate include a plurality of right side mounting apertures.

10. The wall jack according to claim 9, wherein a plurality of nails are driven through one or all of the left side mounting apertures and the right side mounting apertures to strengthen the coupling of the U-bracket onto the strongback.

11. The wall jack according to claim 5, wherein the center plate includes a hanger slot that is a vertically-oriented slot located at a center of the center plate.

12. The wall jack according to claim 11, wherein a width of the hanger slot is wider than a shaft of the bolt but narrower than a diameter of a head of the bolt.

13. The wall jack according to claim 12, wherein the hanger slot connect to a hanger aperture such that the U-bracket is hung on the bolt by pushing the head of the bolt though the hanger aperture and lowering the U-bracket such that the shaft of the bolt slides up into the hanger slot.

14. The wall jack according to claim 5, wherein the wedge includes a wedge plate, an inclined surface, and a wedge slot that forces the U-bracket against the strongback as the strongback coupler is lowered onto the bolt.

15. The wall jack according to claim 14, wherein the wedge plate is coupled to a first face of the center plate and has a vertically-oriented slot located at a center of the wedge plate.

16. The wall jack according to claim 14, wherein the wedge slot and the wedge aperture aligns with a hanger slot and a hanger aperture such that the bolt passes through both the center plate and the wedge plate simultaneously.

17. The wall jack according to claim 14, wherein the inclined surface is located at a center of the wedge plate that is a vertically-oriented thickening of the wedge plate with a narrowest portion of the inclined surface is located at a bottom and a thickest portion of the inclined surface located at a top thereof.

18. The wall jack according to claim 14, wherein a bottom of the inclined surface ends at a top of a wedge aperture and the wedge slot extends through the inclined surface such that the inclined surface does not prevent the bolt from sliding in the wedge slot.

19. The wall jack according to claim 14, wherein a bottom of the wedge slot includes a wedge aperture.

20. The wall jack according to claim 19, wherein a width of the wedge slot is equal to a width of a hanger slot and a diameter of the wedge aperture is equal to a diameter of a hanger aperture.

* * * * *